US009409282B2

(12) United States Patent
Fukui et al.

(10) Patent No.: US 9,409,282 B2
(45) Date of Patent: Aug. 9, 2016

(54) CLAMP APPARATUS

(71) Applicant: SMC KABUSHIKI KAISHA, Chiyoda-ku (JP)

(72) Inventors: Chiaki Fukui, Abiko (JP); Youji Takakuwa, Kitakatsushika-gun (JP)

(73) Assignee: SMC KABUSHIKI KAISHA, Chiyoda-ku (JP)

( * ) Notice: Subject to any disclaimer, the term of this patent is extended or adjusted under 35 U.S.C. 154(b) by 0 days.

(21) Appl. No.: 14/403,728

(22) PCT Filed: Jun. 17, 2013

(86) PCT No.: PCT/JP2013/067151
§ 371 (c)(1),
(2) Date: Nov. 25, 2014

(87) PCT Pub. No.: WO2014/010390
PCT Pub. Date: Jan. 16, 2014

(65) Prior Publication Data

US 2015/0145195 A1 May 28, 2015

(30) Foreign Application Priority Data

Jul. 11, 2012 (JP) ..... 2012-155327

(51) Int. Cl.
*B23Q 3/08* (2006.01)
*B25B 5/12* (2006.01)
*B25B 5/16* (2006.01)

(52) U.S. Cl.
CPC .. *B25B 5/122* (2013.01); *B25B 5/16* (2013.01)

(58) Field of Classification Search
CPC ..... B25B 5/122; B25B 5/16
See application file for complete search history.

(56) References Cited

U.S. PATENT DOCUMENTS 4,905,973 A 3/1990 Blatt
5,967,502 A * 10/1999 Dykstra ..... B25B 5/122 269/228
6,279,886 B1 8/2001 Grossart (Continued)

FOREIGN PATENT DOCUMENTS

CN 1325781 A 12/2001
DE 10057345 A1 5/2001

(Continued)

OTHER PUBLICATIONS

Combined Office Action and Search Report issued on Jul. 21, 2015 in Chinese Patent Application No. 201380036755.0 with English translation.

(Continued)

*Primary Examiner* — Monica Carter
*Assistant Examiner* — Nirvana Deonauth
(74) *Attorney, Agent, or Firm* — Oblon, McClelland, Maier & Neustadt, L.L.P.

(57) ABSTRACT

A clamp apparatus is equipped with a body, and a drive unit having a piston displaced under the supply of a pressure fluid. A clamp arm is disposed rotatably on the body. In addition, a piston rod of the drive unit is connected detachably with respect to a displaceable body of a driving force transmission mechanism which is disposed in the interior of the body. Upon detachment of a connector of the piston rod from a connecting recess of the displaceable body, the state of connection between the drive unit and the driving force transmission mechanism is released.

10 Claims, 10 Drawing Sheets

(56) References Cited

U.S. PATENT DOCUMENTS

| | | | | |
|---|---|---|---|---|
| 6,378,856 | B1 | 4/2002 | Takahashi | |
| 6,641,123 | B2 * | 11/2003 | Takahashi | B25B 5/087 269/222 |

FOREIGN PATENT DOCUMENTS

| | | | | |
|---|---|---|---|---|
| EP | 1060839 | A2 | 12/2000 | |
| FR | 2296494 | | 7/1976 | |
| FR | 2340798 | A1 | 9/1977 | |
| GB | 1523565 | A * | 9/1978 | B25B 5/122 |

OTHER PUBLICATIONS

International Search Report and Written Opinion issued Sep. 11, 2013 in PCT/JP2013/067151 filed Jun. 17, 2013.

* cited by examiner 10
78
16
26
74
62
76
24
20
60
72
18
28
70
22
73
64
68
12
58
12a
B
50
A
54
52
50
34
30
14

CLAMP APPARATUS

TECHNICAL FIELD

The present invention relates to a clamp apparatus, which is driven under the supply of a pressure fluid, for clamping a workpiece on an automated assembly line or the like.

BACKGROUND ART

Heretofore, in an automated assembly line for automobiles, for example, clamping by a clamping apparatus is carried out, in a state in which pre-formed body panels are overlapped and positioned, and an assembly step is carried out whereby the body panels are welded together.

Such a clamp apparatus, for example, as disclosed in U.S. Pat. No. 4,905,973, is equipped with a body, a drive unit which is made up from a cylinder connected to the body, and a clamp arm that projects externally with respect to the body. In addition, by displacing a piston of the drive unit by supplying air to the cylinder, a piston rod is displaced together with the piston, whereby the clamp arm, which is connected to a link mechanism constituted from a plurality of arms, is rotated through a predetermined angle. Consequently, a workpiece or the like can be clamped by the clamp arm.

SUMMARY OF INVENTION

With the aforementioned clamp apparatus, for example, in the case that a malfunction occurs in the drive unit including the piston and the piston rod, the drive unit must be detached from the body and maintenance carried out thereon. However, in such a case, the piston rod of the drive unit and the link mechanism provided on the side of the body are connected by bolts or the like, and after the connection between such components has been released, the drive unit becomes detached from the body. Such an operation is difficult to perform and leads to an increase in the number of process steps and man-hours required to carry out such maintenance.

Further, in the case one wishes to increase the clamping force applied to the workpiece, it is necessary to prepare a different clamp apparatus having a drive unit that produces a different output, and since it is necessary to secure a large storage space for the different clamp apparatus, a single clamp apparatus has been desired, which enables a change in output of the apparatus to easily be implemented.

A general object of the present invention is to provide a clamp apparatus which facilitates and improves ease of maintenance, and which enables a change in output of the apparatus to easily be implemented.

The present invention is characterized by a clamp apparatus for clamping a workpiece by rotation of a clamp arm, comprising:

a body;

a drive unit having a piston that is displaced along an axial direction upon supply of a pressure fluid;

a driving force transmission mechanism disposed in an interior of the body and connected to the drive unit, the driving force transmission mechanism converting linear displacement of the drive unit along the axial direction into rotational displacement, and transmitting a driving force of the drive unit to the clamp arm; and a connection mechanism for switching a state of connection of the drive unit with respect to the driving force transmission mechanism, wherein the drive unit is disposed detachably with respect to the driving force transmission mechanism through the connection mechanism.

According to the present invention, in the clamp apparatus, which is equipped with the drive unit having a piston displaced by supply of a pressure fluid thereto, a driving force transmission mechanism is provided, which converts linear displacement of the piston along an axial direction of the drive unit into rotational displacement, whereby a driving force of the drive unit is transmitted to the clamp arm. In addition, a state of connection of the drive unit with respect to the driving force transmission mechanism can be switched by the connection mechanism.

Accordingly, in the case that a maintenance operation such as exchange of the drive unit or the like is to be carried out, since the connection between the driving force transmission mechanism and the drive unit can easily be released by the connection mechanism, for example, in comparison with the conventional clamp apparatus in which a drive unit and a link mechanism (driving force transmission mechanism) are connected by bolts or the like, it is unnecessary to carry out complicated operations such as removal of bolts or the like. Owing thereto, ease of maintenance of the clamp apparatus can be enhanced. Further, by removal of the drive unit from the body and replacement thereof with a different drive unit, a change in the output of the drive unit in the same clamp apparatus can be implemented.

The above and other objects, features, and advantages of the present invention will become more apparent from the following description when taken in conjunction with the accompanying drawings in which preferred embodiments of the present invention are shown by way of illustrative example.

DESCRIPTION OF EMBODIMENTS

Figure 1:
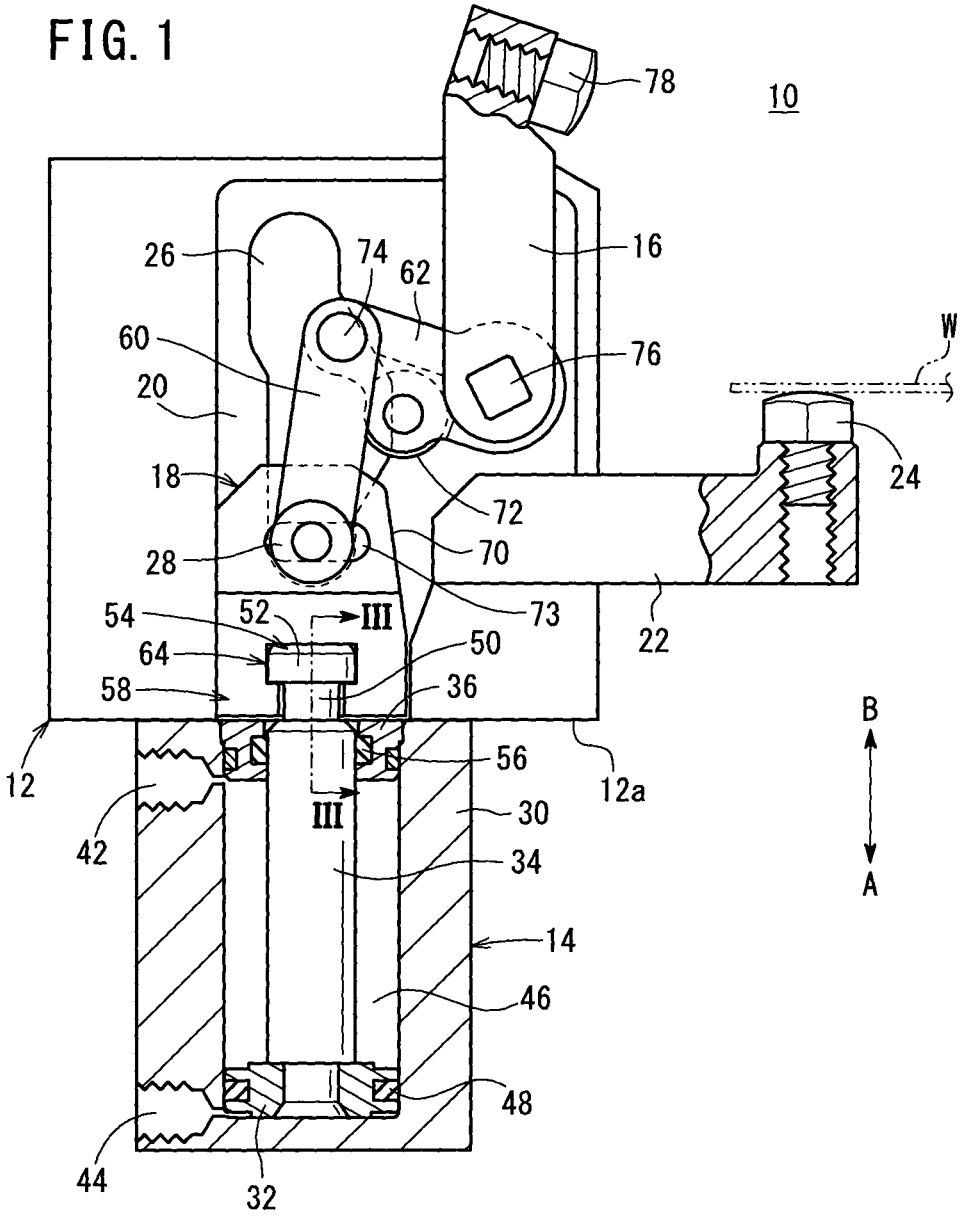
FIG. 1 is an overall cross sectional view of a clamp apparatus according to a first embodiment of the present invention.
Figure 2:
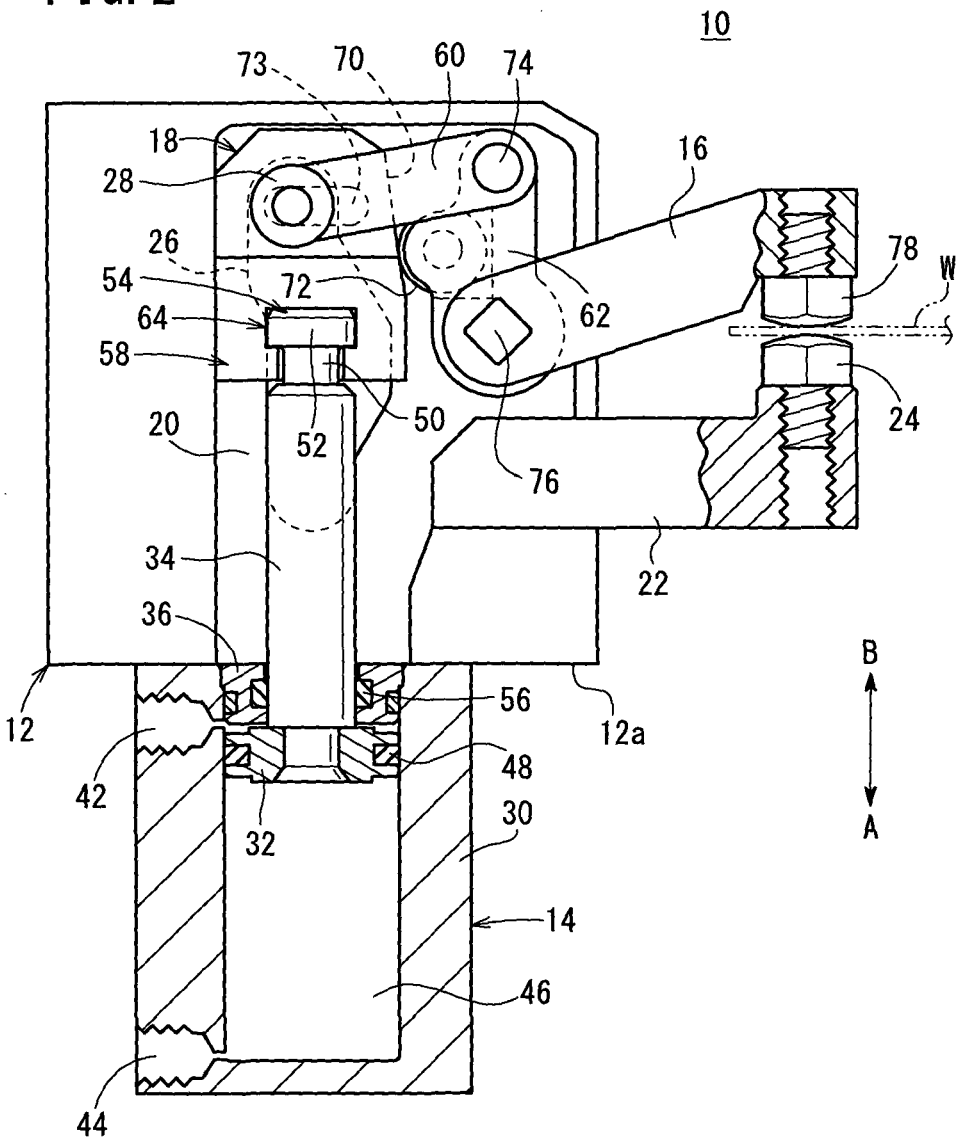
FIG. 2 is an overall cross sectional view showing a clamped state of the clamp apparatus of FIG. 1.
Figure 3:
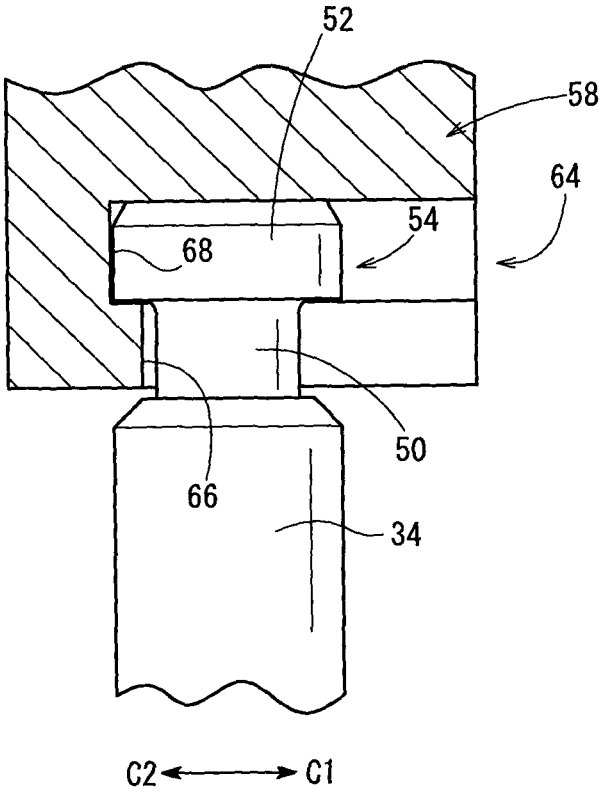
FIG. 3 is a cross sectional view taken along line III-III of FIG. 1.

As shown in FIGS. 1 and 2, a clamp apparatus 10 includes a hollow body 12, a drive unit 14 provided on one end of the body 12, a clamp arm 16 disposed rotatably with respect to the body 12, and a driving force transmission mechanism 18 that transmits a driving force, along an axial directions (the directions of arrows A and B) of the drive unit 14, to the clamp arm 16.

The body 12 is formed, for example, with an elongate rectangular shape in cross section, and is formed in the interior thereof with a housing chamber 20 in which the driving force transmission mechanism 18 is accommodated. The housing chamber 20 opens downwardly (in the direction of the arrow A), and the drive unit 14 is connected to the body 12 so as to close the opening of the housing chamber 20.

A support member 22 is provided on the body 12 which projects in a sideways direction. More specifically, the support member 22 projects horizontally at a predetermined length with respect to the body 12, and is formed on a distal end thereof with an adjustment pin 24, which projects upwardly (in the direction of the arrow B). In addition, as shown in FIG. 2, as will be described later, at a time of clamping when the clamp arm 16 is rotated, a workpiece W is clamped between the clamp arm 16 and the support member 22. The adjustment pin 24 is screw-engaged with respect to the support member 22, and is movable in vertical directions (the directions of arrows A and B) by rotating the adjustment pin 24.

Further, roller grooves 26 are formed in both side surfaces of the body 12, which extend in the vertical direction (the direction of arrow A or B) substantially in the center of both side surfaces. Rollers 28, which are disposed on a later-described displaceable body 58, are inserted in and guided by the roller grooves 26.

The drive unit 14 includes a cylinder tube 30 having a bottom, a piston 32, which is disposed displaceably in the interior of the cylinder tube 30, a piston rod 34 connected to the piston 32, and a rod cover 36 that displaceably supports the piston rod 34.

An open end of the cylinder tube 30 is disposed in abutment against an end surface 12*a* of the body 12. Fastening bolts 40, which are inserted through a pair of penetrating holes 38 (see FIG. 4) that penetrate in the axial direction of the cylinder tube 30, are screw-engaged and connected with respect to the body 12.

Further, a first port 42, which is provided in one end side (in the direction of the arrow B), and a second port 44, which is provided in another end side (in the direction of the arrow A) and separated a predetermined distance with respect to the first port 42, are formed in a side surface of the cylinder tube 30. A cylinder chamber 46 formed in the interior of the cylinder tube 30 communicates with the exterior through the first and second ports 42, 44. The first and second ports 42, 44 are connected through non-illustrated tubes to a non-illustrated pressure fluid supply source. In addition, pressure fluid is supplied selectively to the first port 42 or the second port 44, and is introduced into the cylinder chamber 46 from the non-illustrated pressure fluid supply source.

The piston 32 is formed in the shape of a disk, for example, and a piston packing 48 is installed via an annular groove on the outer circumferential surface of the piston 32. Additionally, by abutment of the piston packing 48 against the inner wall surface of the cylinder chamber 46, leakage of pressure fluid between the piston 32 and the cylinder tube 30 is prevented.

One end of the piston rod 34 is connected integrally by caulking to a hole that is formed in the center of the piston 32 in a state of being inserted through the hole. Further, a connector 54 having an annularly recessed neck part 50, and a head part 52, which is expanded in diameter with respect to the neck part 50, is formed in the other end of the piston rod 34. In addition, the neck part 50 and the head part 52 are connected integrally through engagement with respect to the later-described displaceable body 58 of the driving force transmission mechanism 18. Moreover, the neck part 50 and the head part 52 are formed with circular shapes in cross section having different diameters, respectively.

The rod cover 36 is provided in an opening of the cylinder chamber 46 facing the body 12, thereby closing the opening, and a piston rod 34, which is inserted through the center of the rod cover 36, is supported displaceably along the axial directions (the directions of arrows A and B). A rod packing 56 is installed through an annular groove on an inner circumferential surface of the rod cover 36. The rod packing 56 slides in contact with the outer circumferential surface of the piston rod 34, whereby leakage of pressure fluid to the exterior from the cylinder chamber 46 is prevented.

The driving force transmission mechanism 18 includes the displaceable body 58, which is disposed in the housing chamber 20 of the body 12 and is connected to the other end of the piston rod 34, a pair of rollers 28 provided rotatably on an upper part of the displaceable body 58, a link arm 60 supported pivotally on the displaceable body 58 together with the rollers 28, and a sub-arm 62 connected to the link arm 60 and the clamp arm 16.

The displaceable body 58 is formed with a substantially rectangular shape in cross section, with a connecting recess 64, which is connected to the connector 54 of the piston rod 34, being formed on a lower end of the displaceable body 58.

As shown in FIGS. 1 through 6, the connecting recess 64 includes a small diameter part 66, which is formed on one end surface, so as to open on the end surface side (in the direction of the arrow A) and on one side surface side (in the direction of the arrow C1 in FIG. 4) of the displaceable body 58, and a large diameter part 68 adjacent to the small diameter part 66, which is formed in a direction (the direction of the arrow B) separated from the end surface. Further, the small diameter part 66 and the large diameter part 68 are recessed with semicircular shapes in cross section, respectively, such that the large diameter part 68 has a diameter that is greater than that of the small diameter part 66.

In addition, the neck part 50 of the piston rod 34 is engaged with the small diameter part 66, whereas the head part 52 of the piston rod 34 is engaged with the large diameter part 68. More specifically, the radius of the small diameter part 66 is set to correspond with the diameter of the neck part 50, and the radius of the large diameter part 68 is set to correspond with the diameter of the head part 52.

On the other hand, as shown in FIGS. 1 and 2, an inclined member 70 that tapers gradually toward the upper end, is formed on an upper portion of the displaceable body 58 on a side surface facing toward the clamp arm 16. When the clamp arm 16 is rotated from an unclamped state (see FIG. 1) into a clamped state (see FIG. 2), a sub-roller 72, which is pivotally supported on the sub-arm 62, abuts against the inclined member 70.

The rollers 28 are inserted into the roller grooves 26 that are formed along the axial direction of the body 12, such that upon movement thereof, the displaceable body 58 is guided in the vertical directions (the directions of arrows A and B), and rotational displacement of the displaceable body 58 is restricted.

Further, a shaft of the rollers 28 is inserted in a link groove 73 formed on an upper part of the displaceable body 58, such that the rollers 28 are movable by a predetermined distance in a direction perpendicular to the axial direction (the direction of the arrow A or B) of the displaceable body 58. An end of the link arm 60, which is pivotally supported together with the rollers 28 on the displaceable body 58, also is movable in a direction perpendicular to the axial direction of the displaceable body 58.

The link arm 60 is connected between the sub-arm 62 and an upper part of the displaceable body 58. The link arm 60 is pivotally supported together with the rollers 28 with respect to the displaceable body 58, and is supported mutually and rotatably with respect to the sub-arm 62 through a link pin 74. In addition, the link arm 60 converts linear motion of the piston rod 34 into rotational motion of the clamp arm 16 via the displaceable body 58.

The sub-arm 62 is connected to ends of the link arm 60 and the clamp arm 16, and the sub-roller 72 is axially supported rotatably in the middle of the sub-arm 62. On the other hand, the sub-arm 62 is connected to the clamp arm 16 through support pins 76 having a rectangular shape in cross section. Additionally, upon rotation of the sub-arm 62, the sub-roller 72 rotates in abutment against the inclined member 70 of the displaceable body 58.

The clamp arm 16 is disposed on an outer part of the body 12 having a U-shape in cross section, such that one end thereof is connected to the pair of support pins 76, which project externally of the body 12. In addition, by being connected to the sub-arm 62 via the support pins 76, the clamp arm 16 is axially supported rotatably through the sub-arm 62.

Further, a gripping pin 78 for gripping a workpiece W is provided on the other end of the clamp arm 16. The gripping pin 78 projects with respect to the other end, and is screw-engaged therein so that the projecting height with respect to the other end can be changed. Further, when the workpiece W is clamped as shown in FIG. 2, the gripping pin 78 is disposed so as to confront the adjustment pin 24 on the support member 22. Thus, in a clamped state in which the clamp arm 16 is rotated through a predetermined angle, the workpiece W is clamped and gripped between the gripping pin 78 and the adjustment pin 24.

The clamp apparatus 10 according to the first embodiment of the present invention is constructed basically as described above. Next, operations and effects of the clamp apparatus 10 will be described. In the following descriptions, the unclamped state shown in FIG. 1 shall be treated as an initial position.

In the initial condition, pressure fluid is supplied to the first port 42, and by lowering of the piston 32, via the driving force transmission mechanism 18, the clamp arm 16 is placed in a state of being separated substantially perpendicularly with respect to the support member 22. Further, a thin plate shaped workpiece W is mounted beforehand with respect to the support member 22 of the body 12.

At first, in the initial position of the clamp apparatus 10 shown in FIG. 1, under a switching operation of a non-illustrating switching device, the pressure fluid which had been supplied to the first port 42 is supplied instead to the second port 44 from the pressure fluid supply source, while the first port 42 is placed in a state of being open to atmosphere. Consequently, by action of the pressure fluid, which is introduced from the second port 44 into the cylinder chamber 46, the piston 32 is pressed upwardly toward the side of the body 12 (in the direction of the arrow B), and the piston rod 34 is displaced integrally with the piston 32.

In addition, accompanying displacement of the piston rod 34 and under a guiding action of the rollers 28 with respect to the roller grooves 26, the displaceable body 58 is moved in an upward direction (in the direction of the arrow B), whereupon the link arm 60 starts to rotate clockwise about a location where the link arm 60 is pivotally supported on the displaceable body 58. Together with rotation of the link arm 60, the sub-arm 62 rotates, and by rotation of the sub-arm 62, the clamp arm 16 is rotated through a predetermined angle clockwise about the support pins 76.

Consequently, as shown in FIG. 2, the gripping pin 78 of the clamp arm 16 abuts against the workpiece W, and a clamped state is brought about in which the workpiece W is gripped between the gripping pin 78 and the support member 22 of the body 12.

At this time, accompanying rotation of the clamp arm 16, the rollers 28 are moved via the link arm 60 along the roller grooves 26 in a direction to approach the clamp arm 16, and together therewith, the sub-roller 72 abuts against the inclined member 70 of the displaceable body 58, whereby the clamp arm 16 is pressed, and a locked state is brought about in which rotation of the clamp arm 16 is locked. As a result, the clamped state of the workpiece W by the clamp arm 16 is maintained.

On the other hand, in the event that the clamped state of the workpiece W shown in FIG. 2 is released, under a switching operation of the non-illustrated switching device, the pressure fluid which had been supplied to the second port 44 is supplied instead to the first port 42, while the second port 44 is placed in a state of being open to atmosphere.

By action of the pressure fluid, which is supplied to the first port 42 and introduced into the cylinder chamber 46, the piston 32 is pressed downward in a direction to separate from the body 12 (in the direction of the arrow A), and the piston rod 34 is lowered integrally with the piston 32.

In addition, accompanying displacement of the piston rod 34, the displaceable body 58 is moved in a downward direction under a guiding action of the rollers 28 with respect to the roller grooves 26, and along therewith, the link arm 60 is rotated counterclockwise about a location where the link arm 60 is pivotally supported on the displaceable body 58. Together with rotation of the link arm 60, the sub-arm 62 rotates, and by rotation of the sub-arm 62, the clamp arm 16 is rotated through a predetermined angle counterclockwise about the support pins 76. Consequently, the gripping pin 78 of the clamp arm 16 separates from the support member 22, and the clamped state of the workpiece W is released (see FIG. 1).

A case will now be described in which the drive unit 14 in the clamp apparatus 10 is exchanged. First, in the event that the drive unit 14 is to be exchanged, the clamp arm 16 is placed in the unclamped state shown in FIG. 1, in which the clamp arm 16 is separated from the support member 22. In such a condition, a non-illustrated worker rotates the fastening bolts 40 by which the drive unit 14 is fastened to the body 12, whereupon the connected state of the drive unit 14 with respect to the body 12 is released (see FIG. 4).

Figure 4:
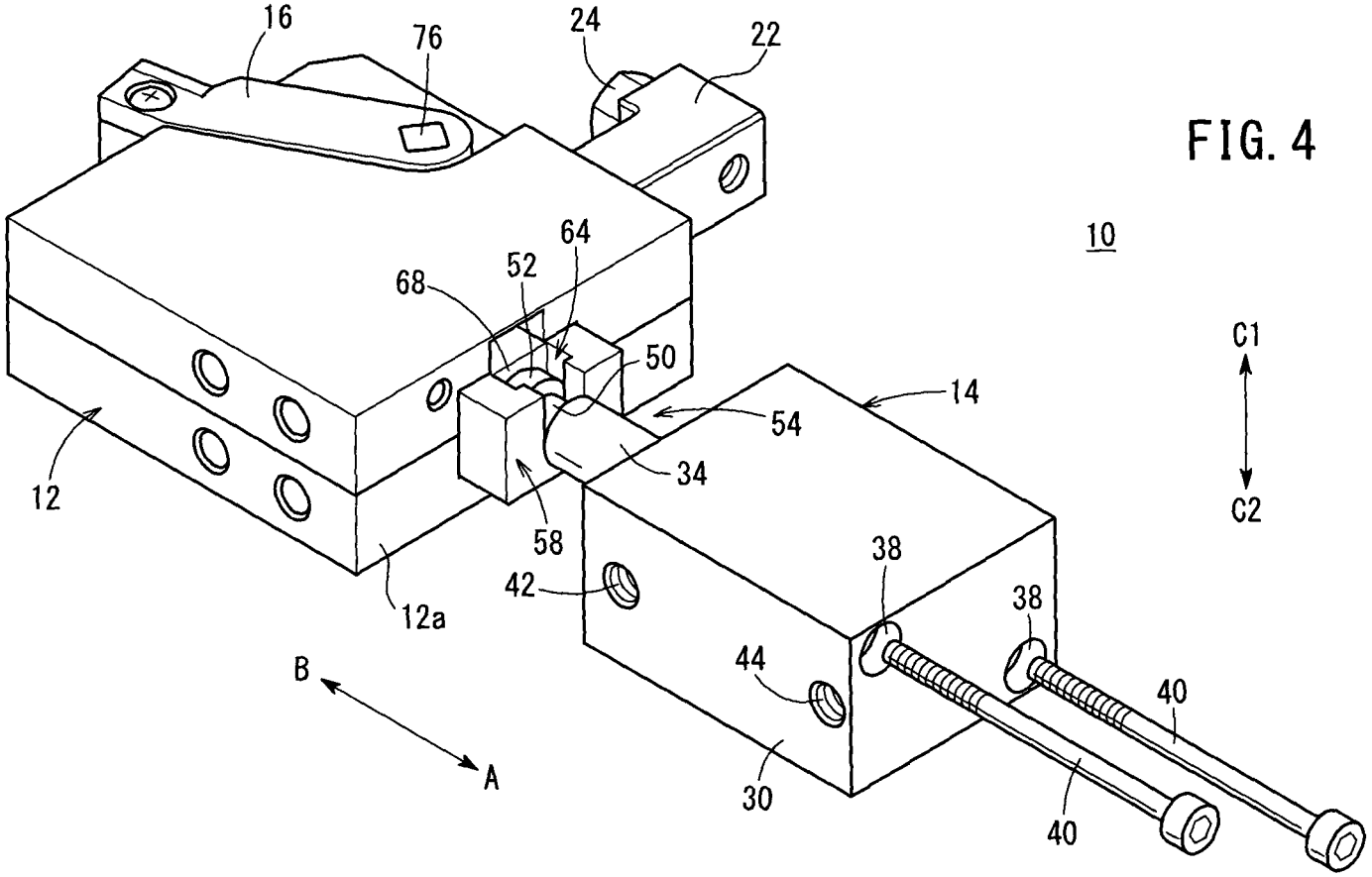
FIG. 4 is a partially exploded perspective view from a drive unit side of the clamp apparatus, and showing a condition in which a displaceable body is projected with respect to a body of the clamp apparatus.
Figure 5:
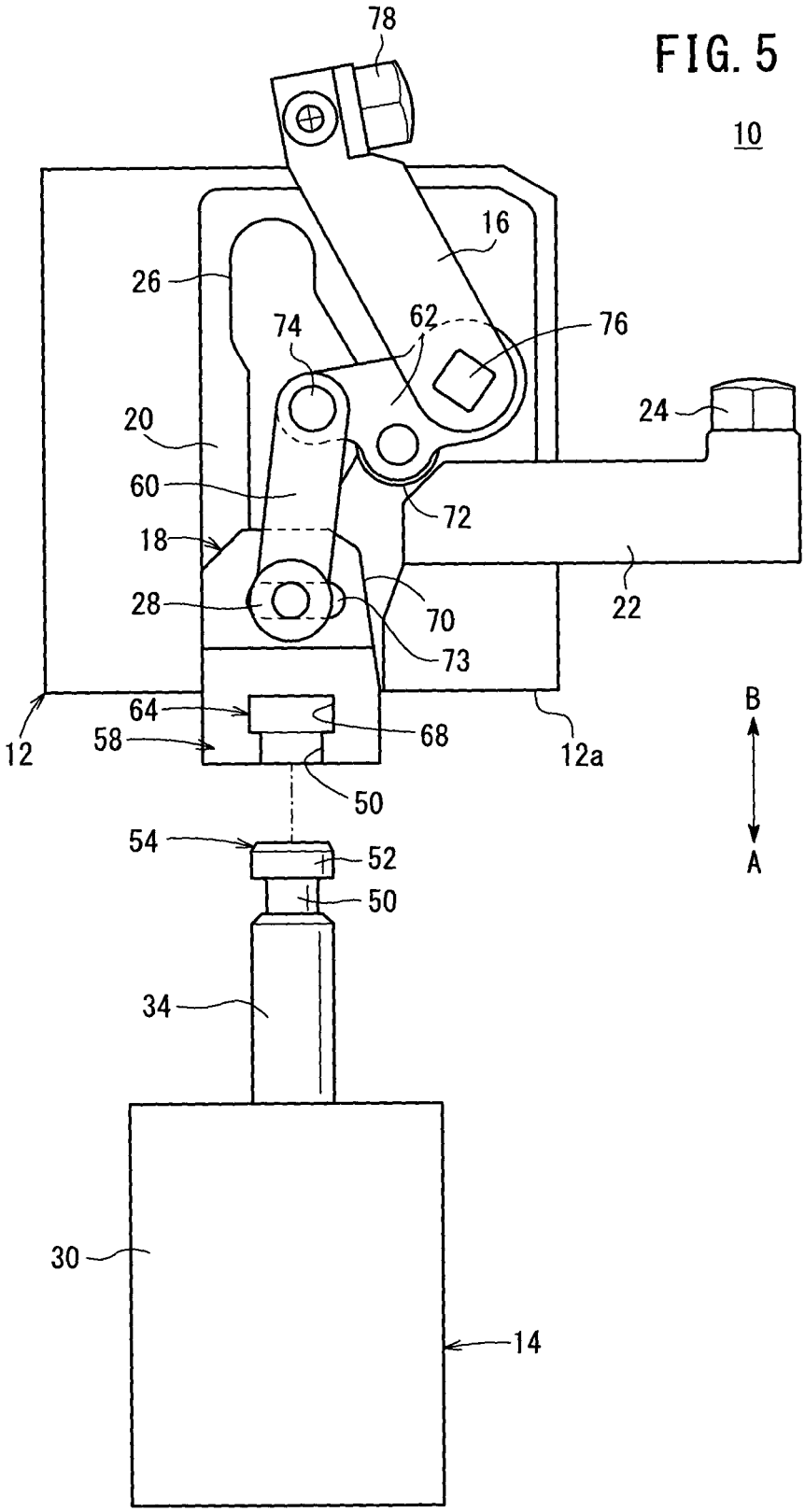
FIG. 5 is a partially exploded side view showing a condition in which the drive unit is detached from the clamp apparatus of FIG. 1.
Figure 6:
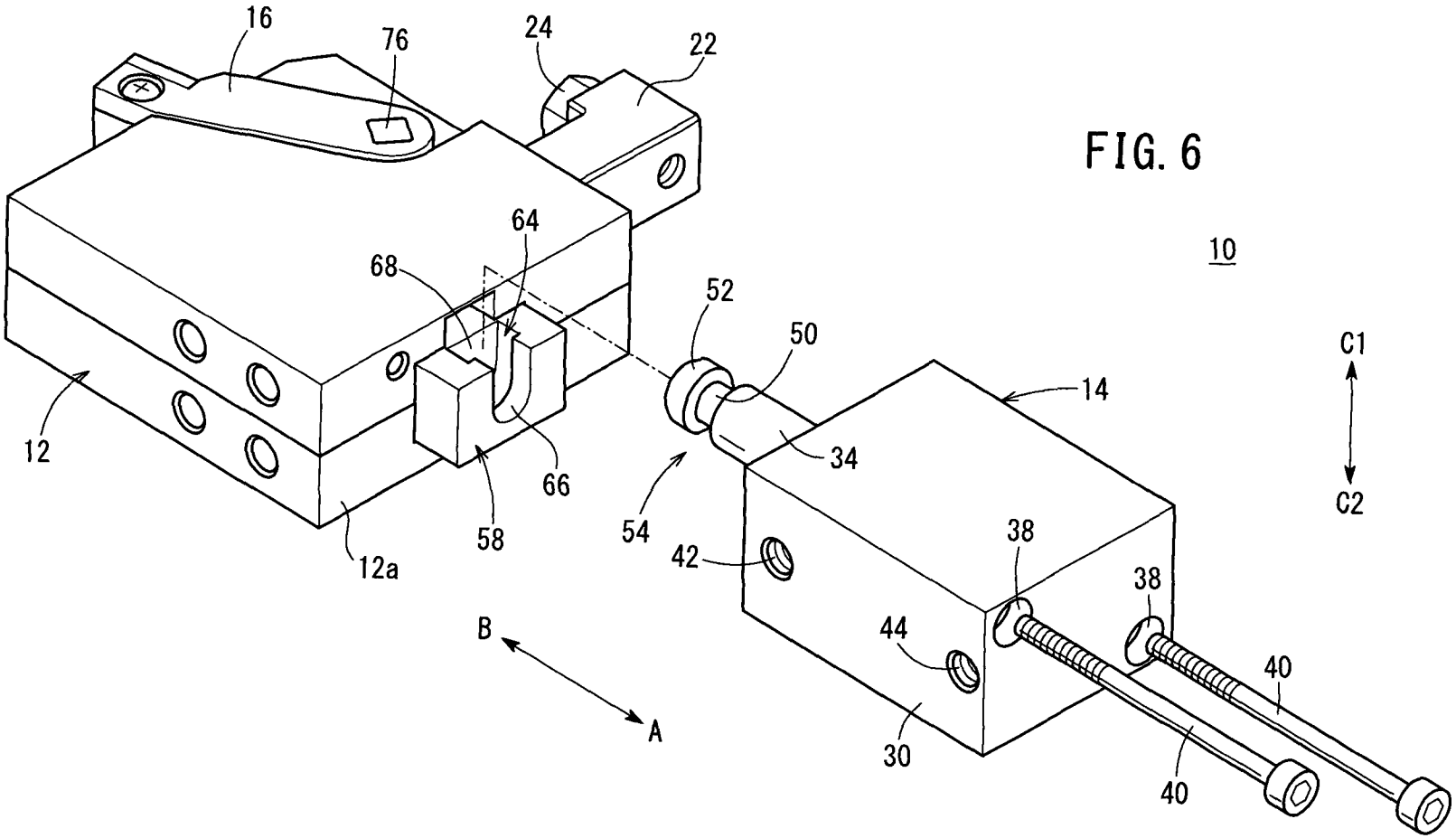
FIG. 6 is a partially exploded perspective view showing the clamp apparatus of FIG. 5 as viewed from the drive unit side.

Next, the other end of the clamp arm 16 is grasped, and as shown in FIG. 4, by further rotating the clamp arm 16 counterclockwise through a predetermined angle, the displaceable body 58, which is connected via the sub-arm 62 and the link arm 60, is moved downward (in the direction of the arrow A). Thus, as shown in FIG. 4, the end of the displaceable body 58 is made to project a predetermined length with respect to the end surface 12*a* of the body 12.

In addition, after the cylinder tube 30 constituting the drive unit 14 has been moved downward (in the direction of the arrow A) to separate away from the body 12, the connector 54 of the piston rod 34 is made to slide in a direction (the direction of the arrow C1 in FIG. 6) perpendicular to the axial direction of the piston rod 34 (the direction of the arrow A or B), whereby the connector 54 is separated from the connecting recess 64 of the displaceable body 58. Consequently, the connected condition between the displaceable body 58 and the piston rod 34 is released, and removal of the drive unit 14 including the piston rod 34 from the body 12 is completed.

Next, in the event that a new drive unit 14 is to be assembled with respect to the body 12, the connector 54 of the piston rod 34 thereof is fitted in engagement with the connecting recess 64 of the displaceable body 58, which projects from the end surface 12*a* of the body 12.

In greater detail, by the connector 54 being made to approach from the side of the one side surface in which the connecting recess 64 is opened, and having the connector 54 slide in a direction (the direction of the arrow C2 in FIG. 6) perpendicular to the axial direction (the direction of arrow A or B) of the piston rod 34, the head part 52 of the connector 54 is inserted into the large diameter part 68, and the neck part 50 is inserted into the small diameter part 66.

In addition, in a state in which the connector 54 of the piston rod 34 is inserted into the connecting recess 64 of the displaceable body 58 (see FIG. 4), the other end of the cylinder tube 30 that makes up the drive unit 14 is slowly made to approach (in the direction of the arrow B) the end surface 12*a* of the body 12, whereupon the other end comes into abutment against the end surface 12*a*. Thereafter, the fastening bolts 40 are inserted through the penetrating holes 38 and screw-engaged with respect to the body 12, whereby the new drive unit 14 is assembled with respect to the body 12 in a state in which the piston rod 34 and the displaceable body 58 are connected together.

At this time, because the connecting recess 64 is open on the one side surface of the displaceable body 58, the piston rod 34 is in a state of being movable in a direction (the direction of the arrow C1) perpendicular to the axial direction of the piston rod 34. However, since a thrust force is applied only in the axial direction (the direction of arrow A or B) to the displaceable body 58 and the piston rod 34, and is not applied in a direction (the direction of the arrow C1) perpendicular to the axial direction, the connected state between the piston 32 and the displaceable body 58 can reliably be maintained.

In the foregoing manner, with the first embodiment, in the clamp apparatus 10 having the drive unit 14 including the piston 32 that is displaced upon supply of a pressure fluid, and in which the clamp arm 16 is rotated by a driving force from the drive unit 14, the connector 54 of the piston rod 34 constituting the drive unit 14 is connectable with the displaceable body 58 of the driving force transmission mechanism 18 that transmits the driving force of the drive unit 14 to the clamp arm 16. Owing thereto, in the case that a maintenance operation such as exchanging the drive unit 14 or the like is carried out, merely by a simple operation of detaching the piston rod 34 from the displaceable body 58 after the displaceable body 58 has been made to project from the body 12, an operation can be performed easily to remove the drive unit 14. As a result, in comparison with the conventional clamp apparatus in which a drive unit and a link mechanism (driving force transmission mechanism) are connected by bolts or the like, it is unnecessary to carry out complicated operations such as removal of bolts or the like. Owing thereto, ease of maintenance of the clamp apparatus 10 can be enhanced.

Further, in the clamp apparatus 10, by exchanging the drive unit 14 with a different drive unit 14 having a piston 32 that differs in cross sectional area, a change in output of the drive unit 14 can easily be carried out using the same body 12 including the driving force transmission mechanism 18. As a result, in the case it is desired to change the clamping force imposed on the workpiece W by the clamp arm 16, by exchanging the drive unit 14 with a different drive unit 14 having a different output, the size of the thrust force transmitted to the driving force transmission mechanism 18 through the piston rod 34 can be changed. Owing thereto, simply by exchanging the drive unit, the clamping force applied by the clamp arm 16 can easily be changed in a single clamp apparatus 10.

More specifically since it is unnecessary to prepare a plurality of clamp apparatus that exhibit different clamping forces, equipment investments can be suppressed.

Furthermore, since the opening of the housing chamber 20 is closed by the drive unit 14 without being open to the exterior, a fluidtight state can be provided in the interior of the housing chamber 20 of the body 12. Owing thereto, even in the event that water or the like is used by an assembly line in which the clamp apparatus 10 is employed, such water can be prevented from infiltrating into the interior, and spatter generated on a welding line or the like can be prevented from entering the interior.

Further, the drive unit 14 is not limited to a structure having a single piston 32 as in the foregoing embodiment. For example, as shown in FIG. 7, a drive unit 80 may be used which is equipped with two first and second pistons 84, 86 disposed displaceably in the interior of a cylinder tube 82.

Figure 7:
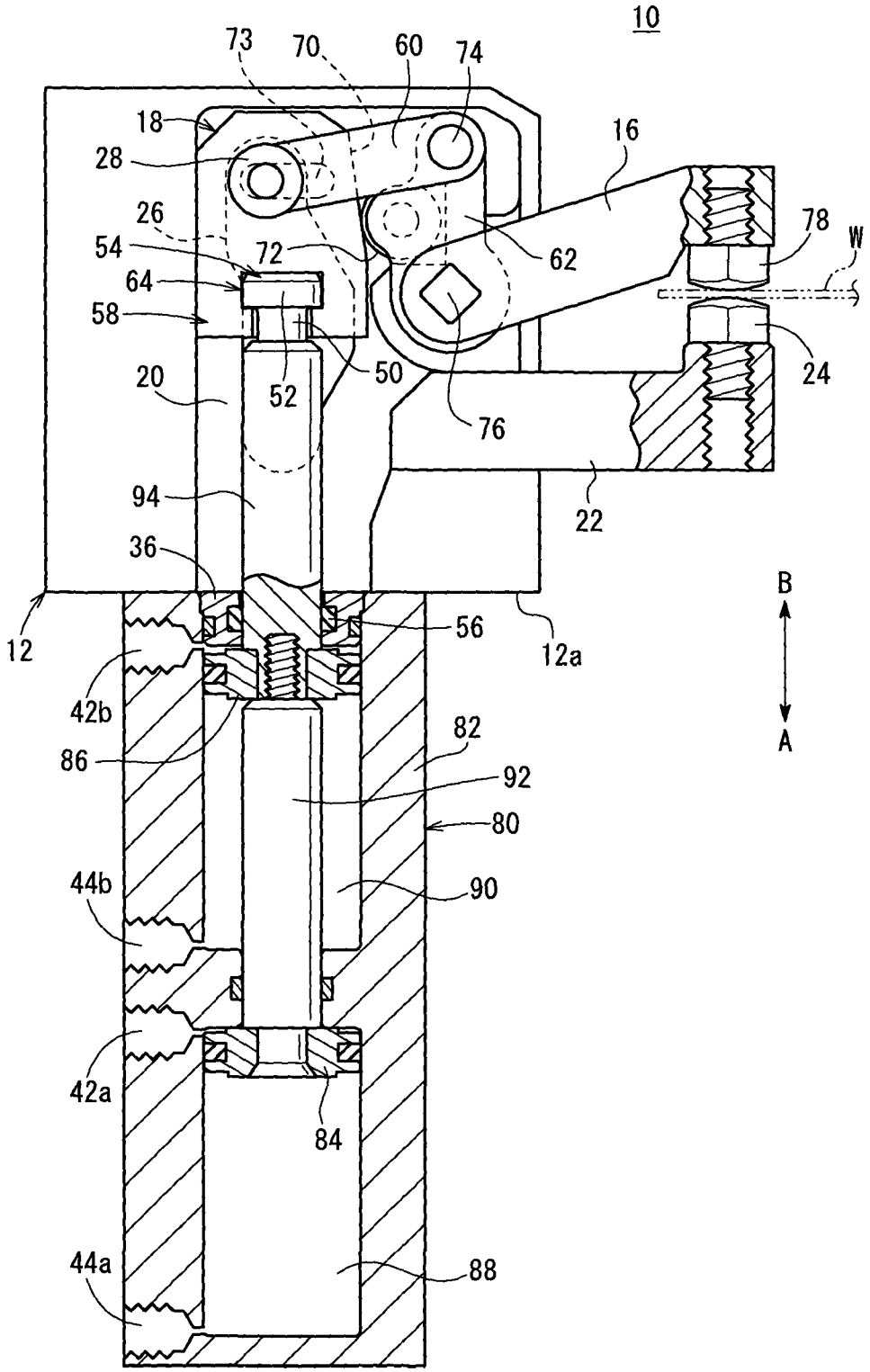
FIG. 7 is an overall cross sectional view of the clamp apparatus having a drive unit according to a modified example, which includes first and second pistons.

With the drive unit 80, as shown in FIG. 7, on a side surface of the cylinder tube 82, first and second ports 42*a*, 42*b*, 44*a*, 44*b* are provided in each of respective pairs, and the cylinder tube 82 is formed with a first cylinder chamber 88 in which a first piston 84 is accommodated, and a second cylinder chamber 90 in which a second piston 86 is accommodated. The first cylinder chamber 88 and the second cylinder chamber 90 are separated, and are formed so as not to communicate with each other, and the first cylinder chamber 88 and the second cylinder chamber 90 communicate respectively with the first and second ports 42*a*, 42*b*, 44*a*, 44*b*.

Further, the first piston 84 and the second piston 86 are connected respectively to a first piston rod 92 and a second piston rod 94, and by being connected mutually to an end of the first piston rod 92 and an end of the second piston rod 94, the first and second pistons 84, 86 are connected in series through the first and second piston rods 92, 94.

In addition, for example, in the case that the clamp apparatus 10 is switched from an unclamped state to a clamped state, a pressure fluid is supplied respectively to the pair of second ports 44*a*, 44*b*, whereby the first and second pistons 84, 86 are displaced toward the side of the body 12 (in the direction of the arrow B) integrally and simultaneously with the first and second piston rods 92, 94. More specifically, compared to the drive unit 14 equipped with a single piston 32, a thrust force of roughly two times can be obtained, and accompanying such an increased thrust force, the clamping force applied by the clamp arm 16 can be increased.

The piston that constitutes the drive unit 14 is not limited to the aforementioned case in which the two first and second pistons 84, 86 are disposed in series, and the thrust force can be increased by connecting two or more pistons in series.

Figure 8:
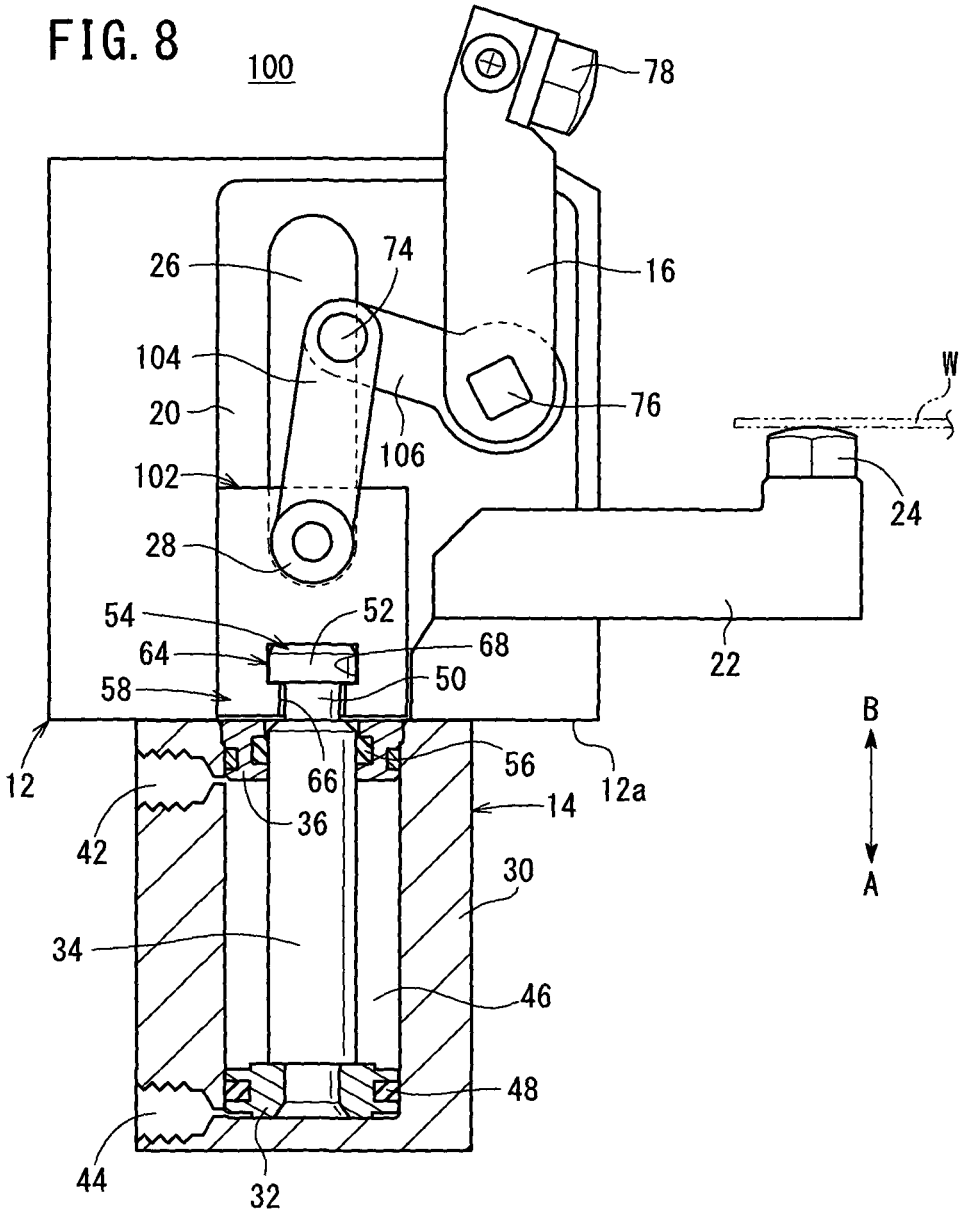
FIG. 8 is an overall cross sectional view of a clamp apparatus according to a second embodiment of the present invention.
Figure 9:
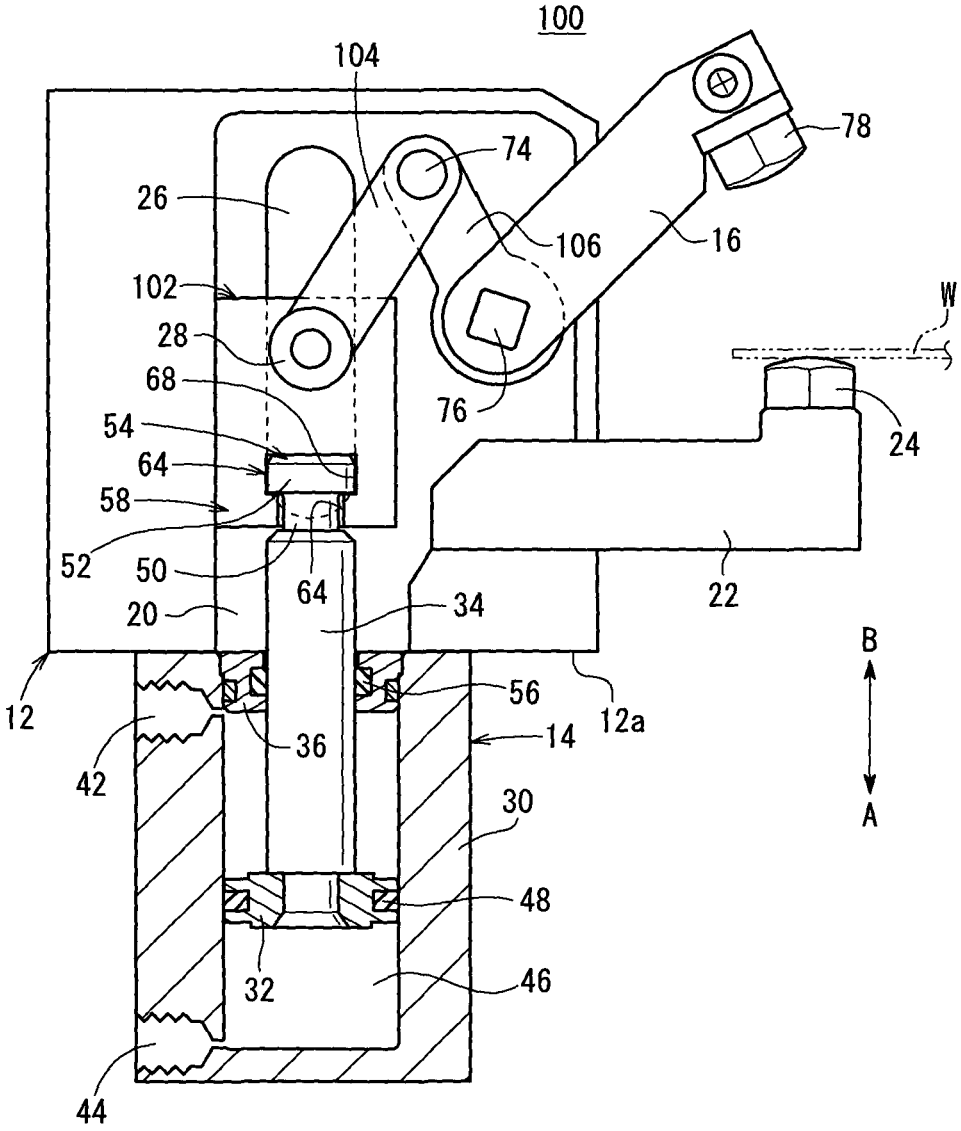
FIG. 9 is an overall cross sectional view of the clamp apparatus of FIG. 8, showing a condition in which the clamp arm is rotated through a predetermined angle.
Figure 10:
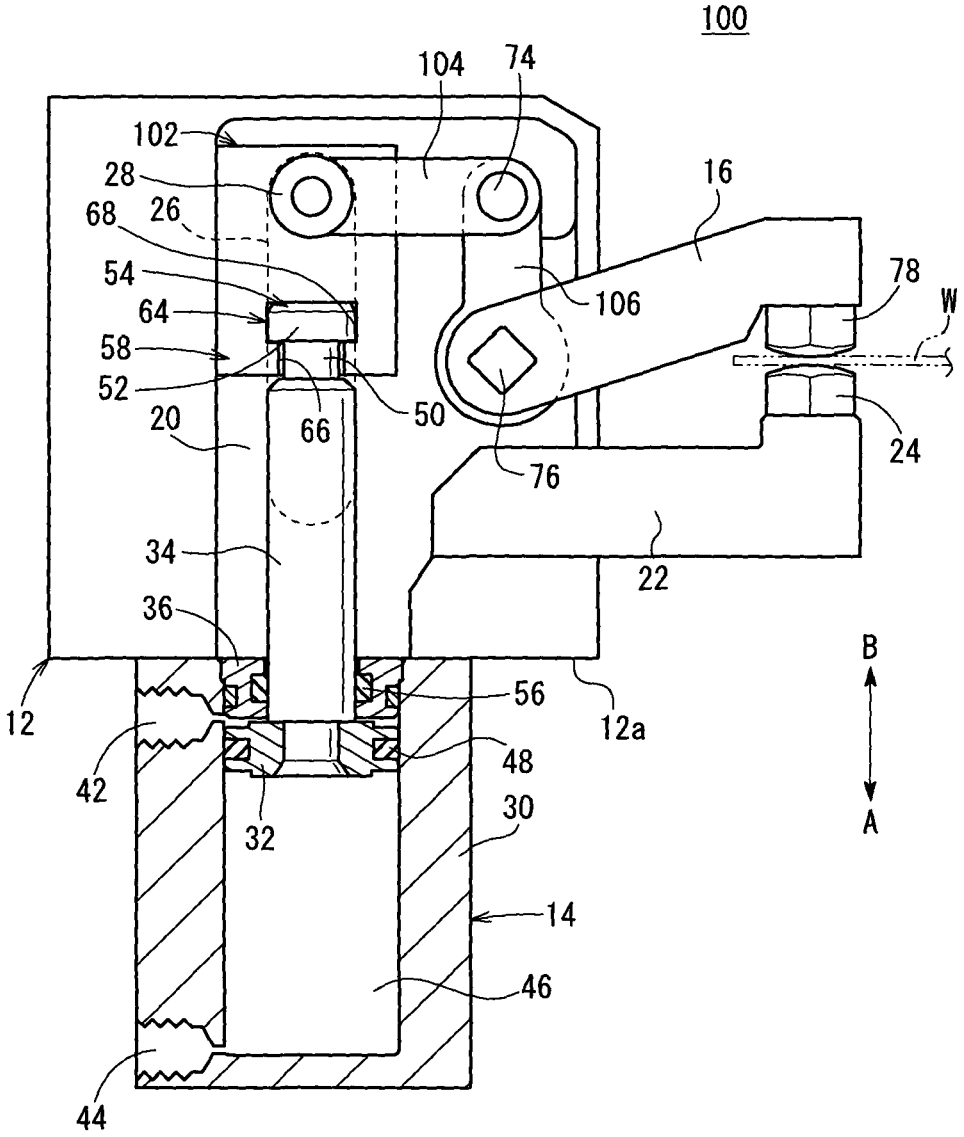
FIG. 10 is an overall cross sectional view showing a clamped state of the clamp apparatus of FIG. 8.

Next, a clamp apparatus 100 according to a second embodiment is shown in FIGS. 8 through 10. Structural elements thereof, which are the same as those of the clamp apparatus 10 according to the aforementioned first embodiment, are denoted by the same reference characters, and detailed descriptions of such features are omitted.

The clamp apparatus 100 according to the second embodiment differs from the clamp apparatus 10 according to the first embodiment, in that a driving force of the drive unit 14 is transmitted to the clamp arm 16 from a toggle link mechanism 102.

The toggle link mechanism 102 is disposed in the housing chamber 20 of the body 12 and includes a link arm 104, which is supported pivotally together with the rollers 28 on an upper part of the displaceable body 58. The toggle link mechanism 102 converts linear motion of the piston rod 34, which is connected to the displaceable body 58, into rotational motion of the clamp arm 16. One end of the link arm 104 is supported pivotally on an upper part of the displaceable body 58, whereas the other end thereof is supported pivotally on an end of a sub-arm 106.

With the clamp apparatus 100 constructed in the foregoing manner, in the initial position shown in FIG. 8, by supply of pressure fluid to the second port 44 of the drive unit 14, the piston 32 and the piston rod 34 are raised integrally, accompanied by the displaceable body 58 being moved upwardly (in the direction of the arrow B) under a guiding action of the rollers 28 with respect to the roller grooves 26. In addition, accompanying rising of the displaceable body 58, the link arm 104 starts to rotate clockwise about a location where the link arm 104 is pivotally supported on the displaceable body 58, and via the sub-arm 106, the clamp arm 16 is rotated through a predetermined angle clockwise about the support pins 76 (see FIG. 9).

In addition, upon further rising of the piston 32, the link arm 104 and the sub-arm 106 are rotated under a displacement action of the displaceable body 58, accompanied by the clamp arm 16 being rotated further in a clockwise direction. Consequently, the gripping pin 78 of the clamp arm 16 abuts against the workpiece W, and a clamped state is brought about in which the workpiece W is gripped between the gripping pin 78 and the support member 22 of the body 12 (see FIG. 10). At this time, the link arm 104 is maintained in a substantially horizontal orientation, whereby the clamped state of the workpiece by the clamp arm 16 is locked.

In the foregoing manner, with the second embodiment, in the clamp apparatus 100 having the toggle link mechanism 102, the connector 54 of the piston rod 34 constituting the drive unit 14 is connectable with the displaceable body 58 of the driving force transmission mechanism 18 that transmits the driving force of the drive unit 14 to the clamp arm 16. Owing thereto, in the case that a maintenance operation such as exchanging the drive unit 14 or the like is carried out, merely by a simple operation of detaching the piston rod 34 from the displaceable body 58 after the displaceable body 58 has been made to project from the body 12, an operation can be performed easily to remove the drive unit 14. As a result, in comparison with the conventional clamp apparatus in which a drive unit and a link mechanism (driving force transmission mechanism) are connected by bolts or the like, it is unnecessary to carry out complicated operations such as removal of bolts or the like. Owing thereto, ease of maintenance of the clamp apparatus 100 can be enhanced.

Further, in the clamp apparatus 100, by exchanging the drive unit 14 with a different drive unit 14 having a piston 32 that differs in cross sectional area, a change in output of the drive unit 14 can easily be carried out using the same body 12 including the driving force transmission mechanism 18. As a result, in the case it is desired to change the clamping force imposed on the workpiece W by the clamp arm 16, by exchanging the drive unit 14 with a different drive unit 14 having a different output, the size of the thrust force transmitted to the driving force transmission mechanism 18 through the piston rod 34 can be changed, and along therewith, the clamping force applied by the clamp arm 16 can easily be changed in a single clamp apparatus 100.

Furthermore, since the opening of the housing chamber 20 is closed by the drive unit 14 without being open to the exterior, a fluidtight state can be provided in the interior of the housing chamber 20 of the body 12. As a result, for example, even in the case that water or the like is used by the assembly line in which the clamp apparatus 100 is employed, such water can be prevented from infiltrating into the interior, and spatter generated on a welding line or the like can be prevented from entering the interior of the housing chamber 20.

With the aforementioned first and second embodiments, a case has been described in which the first and second ports 42, 44 of the drive unit 14 are provided on a side surface, which is opposite from the side on which the support member 22 projects from the body 12. However, by reversing the direction in which the drive unit 14 is assembled, the position of the first and second ports 42, 44 can easily be changed to the side of the support member 22. More specifically, the position of the first and second ports 42, 44 can be changed selectively responsive to the work environment in which the clamp apparatus 10, 100 are used.

Further, by providing a position detecting sensor, which is capable of detecting the displacement position of the piston 32 in the drive unit 14, the angle of rotation of the clamp arm 16 can be detected based on the position of the piston 32, thus enabling clamped and unclamped states of the clamp arm 16, for example, to be confirmed reliably.

Furthermore, with the clamp apparatus 10, 100 according to the above-described first and second embodiments, a case has been described in which an air driven type of drive unit 14 is applied for displacing the piston 32 upon supply of a pressure fluid. However, the invention is not limited to this feature, and for example, a hydraulically driven type of drive unit 14 may be used in which hydraulic oil is used as the pressure fluid. By using a hydraulically driven type of drive unit 14, compared to an air driven type, a larger drive force can be obtained, which is suitable for cases in which workpieces W are to be clamped by a large clamping force.

The clamp apparatus according to the present invention is not limited to the above embodiments. Various changes and modifications may be made to the embodiments without departing from the scope of the invention as set forth in the appended claims.

The invention claimed is:

1. A clamp apparatus for clamping a workpiece by rotation of a clamp arm, comprising:

a body;

a drive unit having a piston that is displaced along an axial direction upon supply of a pressure fluid;

a driving force transmission mechanism disposed in an interior of the body and connected to the drive unit, the driving force transmission mechanism converting linear displacement of the drive unit along the axial direction into rotational displacement, and transmitting a driving force of the drive unit to the clamp arm; and a connection mechanism for switching a state of connection of the drive unit with respect to the driving force transmission mechanism, wherein the drive unit is disposed detachably with respect to the driving force transmission mechanism through the connection mechanism, wherein the connection mechanism comprises a connector formed on an end of a piston rod that is connected to the piston; and a linkage formed on an end of a displaceable body of the driving force transmission mechanism on a side near the drive unit, the linkage being engaged with the connector, wherein the displaceable body is displaceable to project to an exterior of the body, and wherein the linkage is open on one side in the exterior.

2. The clamp apparatus according to claim 1, wherein by engagement of the connector with the linkage, a state of connection is brought about, in which relative displacement in the axial direction between the piston rod and the displaceable body is restricted.

3. The clamp apparatus according to claim 1, further comprising a lock mechanism for restricting rotary movement of the clamp arm at a time of clamping when the workpiece is clamped by the clamp arm.

4. The clamp apparatus according to claim 3, the lock mechanism comprising:

a roller disposed rotatably on the clamp arm; and an inclined member against which the roller abuts, and which is inclined at a predetermined angle with respect to a direction of displacement of the displaceable body, wherein the inclined member is inclined such that, at the time of clamping, the inclined member presses the roller gradually toward a side of the clamp arm.

5. The clamp apparatus according to claim 1, the driving force transmission mechanism including:

a first arm pivotally supported on the displaceable body on an end of the piston rod connected to the piston; and a second arm pivotally supported on an end of the first arm and on an end of the clamp arm, the clamp apparatus further comprising a toggle link mechanism, which transmits a driving force of the drive unit to the clamp arm via the first and second arms for rotating the first and second arms.

6. The clamp apparatus according to claim 1, wherein the connector includes a neck part, which is recessed annularly with respect to an end of the piston rod, and a head part, which is expanded in diameter with respect to the neck part, the neck part being engaged with a small diameter part of the linkage, and the head part being engaged with a large diameter part having a diameter larger than that of the small diameter part.

7. The clamp apparatus according to claim 6, wherein the small diameter part and the large diameter part are recessed with semicircular shapes in cross section, respectively, in a side surface of the displaceable body.

8. The clamp apparatus according to claim 1, wherein the body comprises a support member for clamping the workpiece between the clamp arm and the support member.

9. The clamp apparatus according to claim 5, wherein the displaceable body comprises a groove elongated in a direction perpendicular to a driving direction of the drive unit, and wherein the end of the first arm is engaged with the groove.

10. The clamp apparatus according to claim 8, wherein the support member is adapted to extend substantially parallel to the clamp arm in a clamping state of the clamp arm.

* * * * *